US007736177B2

(12) United States Patent
Tsai

(10) Patent No.: US 7,736,177 B2
(45) Date of Patent: Jun. 15, 2010

(54) ELECTRICAL CONNECTOR HAVING IMPROVED CONTACTS THEREIN

(75) Inventor: Tzu-Ching Tsai, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/229,643

(22) Filed: Aug. 25, 2008

(65) Prior Publication Data

US 2009/0053939 A1 Feb. 26, 2009

(30) Foreign Application Priority Data

Aug. 24, 2007 (TW) ..... 96214105 U

(51) Int. Cl.
*H01R 13/60* (2006.01)

(52) U.S. Cl. ..... 439/570; 439/74; 439/660

(58) Field of Classification Search ..... 439/74, 439/660, 570, 560
See application file for complete search history.

(56) References Cited

U.S. PATENT DOCUMENTS 7,112,091 B2 * 9/2006 Okura et al. ..... 439/570
7,172,434 B2 * 2/2007 Obikane et al. ..... 439/74
7,172,449 B2 * 2/2007 Shindo et al. ..... 439/341
7,354,279 B2 * 4/2008 Uesaka ..... 439/74
7,384,274 B1 * 6/2008 Chen et al. ..... 439/74

FOREIGN PATENT DOCUMENTS

JP 3707016 B2 8/2005

* cited by examiner

*Primary Examiner*—Hien Vu
(74) *Attorney, Agent, or Firm*—Ming Chieh Chang; Wei Te Chung; Andrew C. Cheng

(57) ABSTRACT

An electrical connector mounted on a PCB (printed circuit board) includes an insulating housing having a receiving room and a plurality of contacts retained in the insulating housing. Said insulating housing has a tongue portion and a peripheral wall surrounds said tongue portion which defines said receiving room. Each contact includes a U-shaped contacting portion received in said receiving room, a vertical holding portion retained in an inner surface of said peripheral wall and a connecting portion connecting with said contacting portion and said holding portion. Said connecting portion has a linear leading surface which is formed slanted towards said contacting portion downwardly in order to provide a smooth mating process with a mating connector.

5 Claims, 9 Drawing Sheets

ELECTRICAL CONNECTOR HAVING IMPROVED CONTACTS THEREIN

BACKGROUND OF THE INVENTION

1. Field of the Invention

The present invention relates to an electrical connector, and more particularly to an electrical connector mounted on a PCB (printed circuit board).

2. Description of Related Art

An electrical connector for mating with a mating connector is widely used in electronics device nowadays. As disclosed in JP. Pat. No. 3707016B2, an electrical connector assembly for connecting two PCBs comprises a plug and a receptacle. Said receptacle includes a rectangular insulating housing and a plurality of contacts retained in said insulating housing. The insulating housing has two pairs of peripheral walls and a tongue portion formed therebetween. Said peripheral walls and said tongue portion defines a receiving room and a plurality of passageways for receiving said plug and said contacts respectively. Each contact of the receptacle has a U-shaped contacting portion received in said receiving room, a vertical holding portion engaged with a peripheral wall of said insulating housing, a connecting portion connecting said U-shaped contacting portion with a top end of said vertical holding portion, and a soldering portion extending out of the insulating housing from a bottom end of said vertical holding portion. Said plug comprises a housing and a plurality of terminals retained on a sidewall of the housing. Said terminal has a U-shaped contacting beam which is arranged on an inner surface and an outer surface of the sidewall of the plug. During the process of assembly between said plug and said receptacle, said sidewalls and said U-shaped contacting beam arranged thereon of the plug are inserted into said receiving room of the receptacle in order to engage with said U-shaped contacting portion of the receptacle electrically. As shown in FIG. 1 of JP. Pat. No. 3707016B2, the contact of the receptacle might which fails to provide a smooth mating with said terminal of the plug. Moreover, the contact of said receptacle may be cracked if the mating force is too much strong.

So it is necessary to provide a new electrical connector to solve the problems above.

SUMMARY OF THE INVENTION

Accordingly, an object of the present invention is to provide an electrical connector with improved contacts therein, in which the mating process with a mating connector is more smooth.

In order to achieve above-mentioned object, an electrical connector is provided which comprises an insulating housing having a pair of sidewalls and a plurality of passageways formed thereon, said sidewalls define a receiving room therein; a plurality of contacts are received in said passageways, each contact has an U-shaped contacting portion, a holding portion retained in passageways vertically and a connecting portion connecting with said contacting portion and holding portion; said connecting portion has a linear leading surface which is formed slanted towards said contacting portion downwardly.

Other objects, advantages and novel features of the present invention will become more apparent from the following detailed description of the present embodiment when taken in conjunction with the accompanying drawings.

DETAILED DESCRIPTION OF THE INVENTION

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Figure 1:
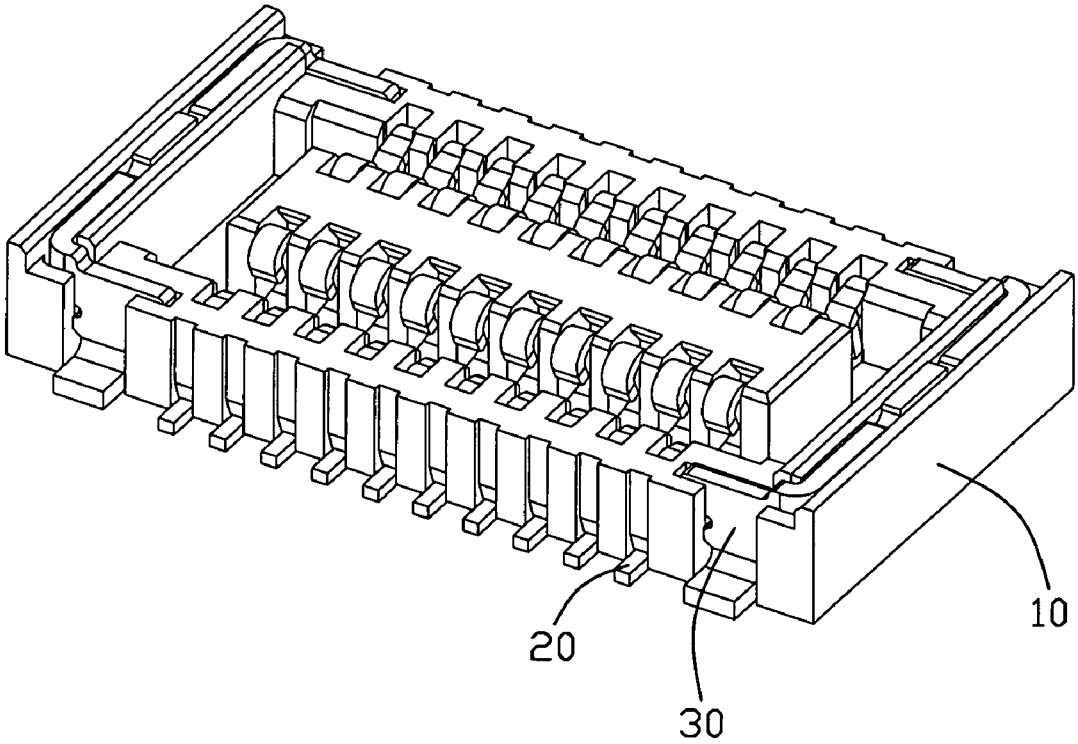
FIG. 1 is an assembled, perspective view of an electrical connector in accordance with an embodiment of the present invention.
Figure 2:
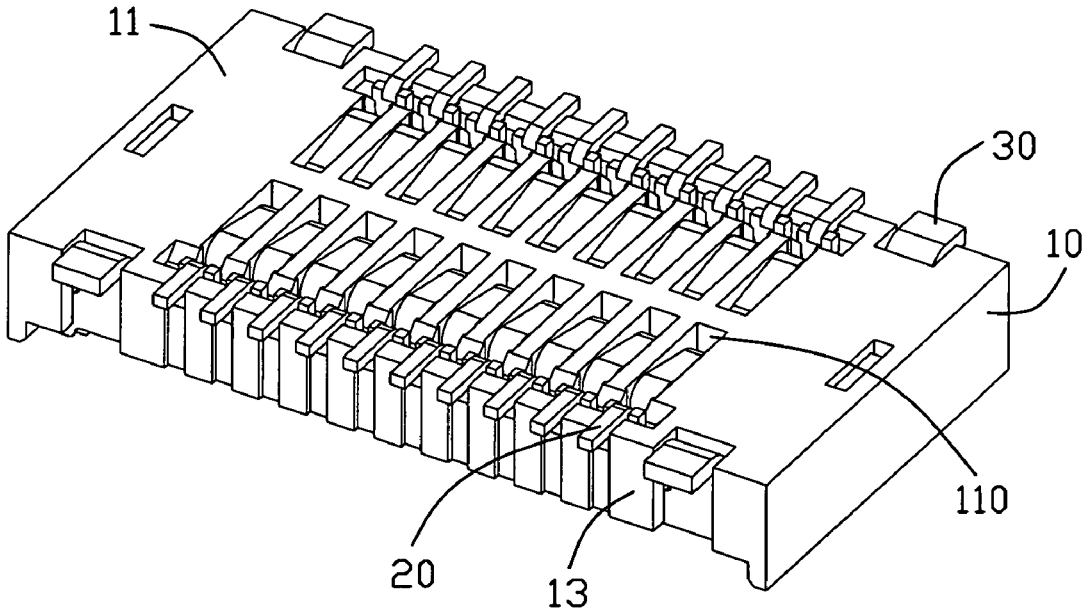
FIG. 2 is another assembled, perspective view of the electrical connector in accordance with the embodiment of the present invention.
Figure 3:
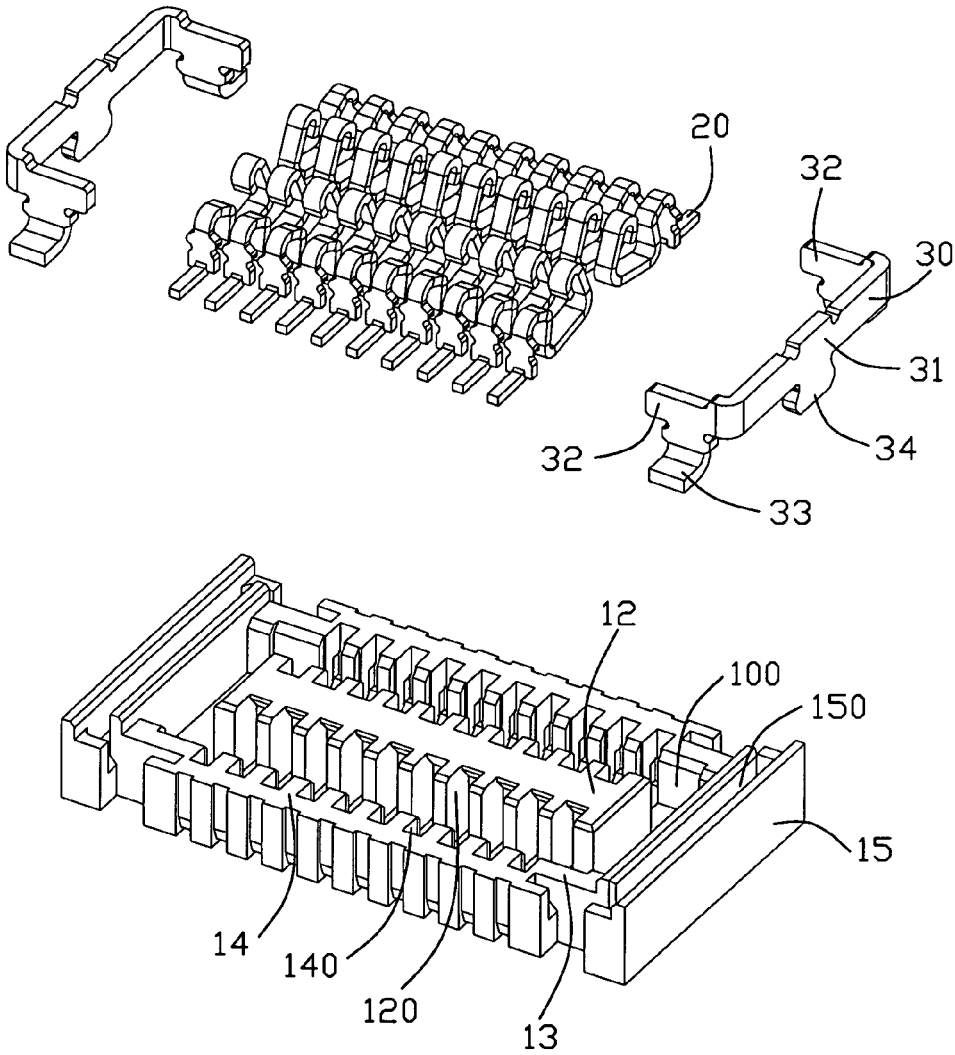
FIG. 3 is an exploded, perspective view of the electrical connector in accordance with FIG. 1.
Figure 5:
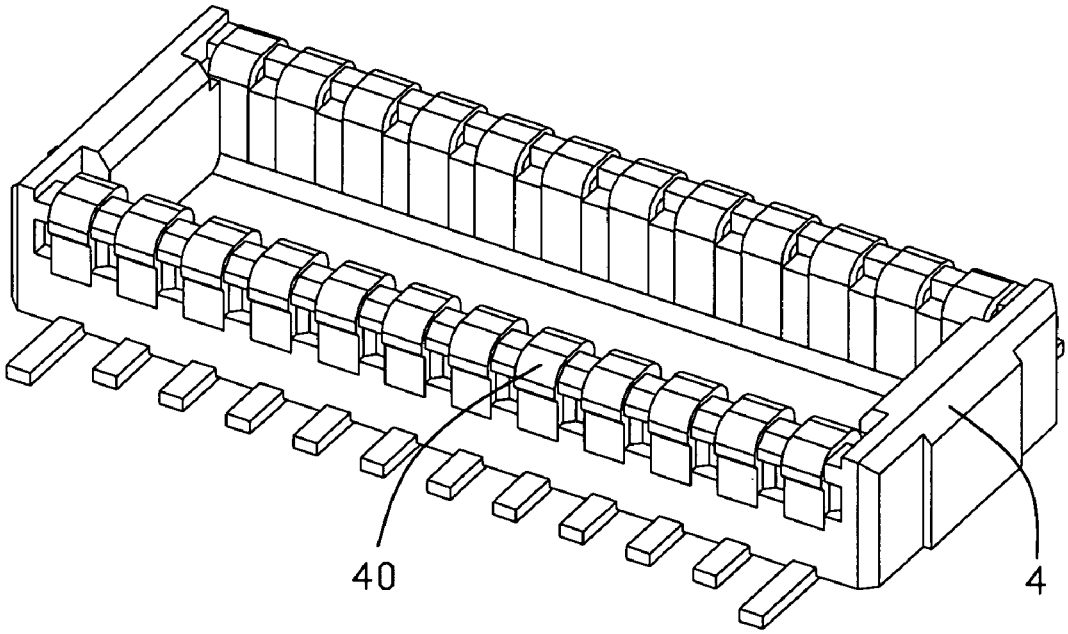
FIG. 5 is an assembled, perspective view of a mating connector mating with said electrical connector of the present invention.
Figure 6:
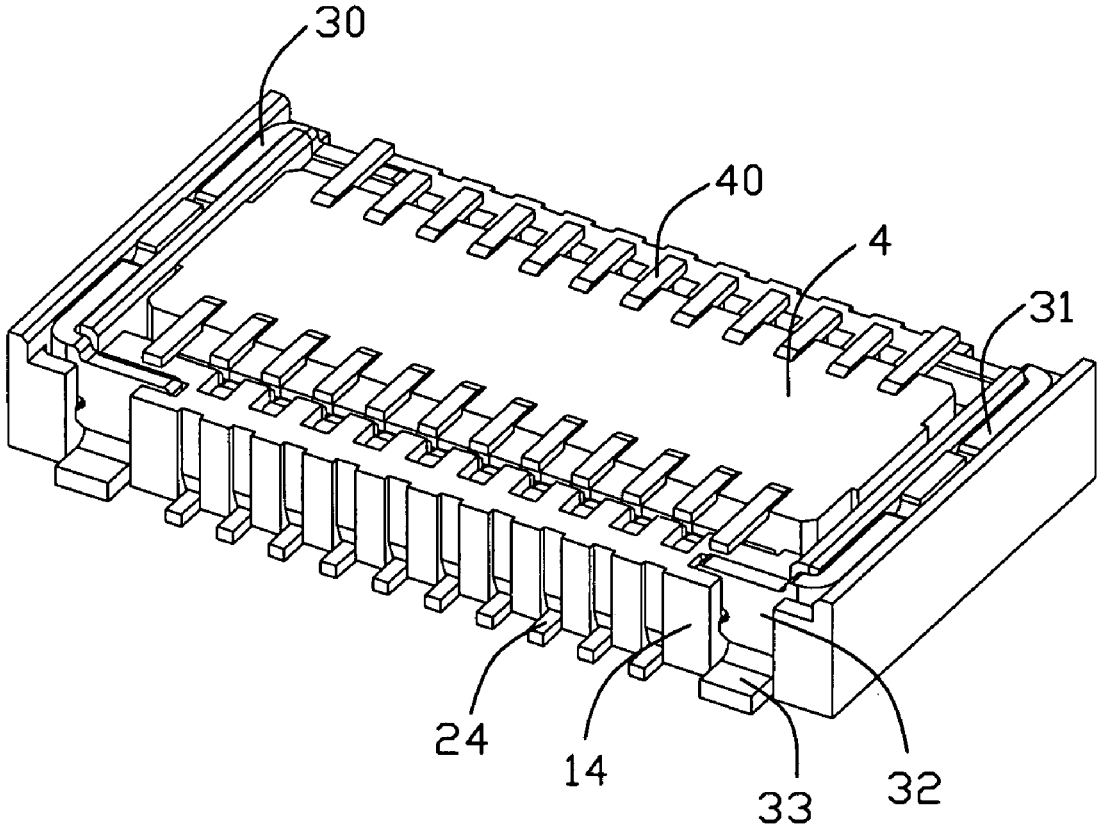
FIG. 6 is an assembled, perspective view of said electrical connector after mating with said mating connector.
Figure 7:
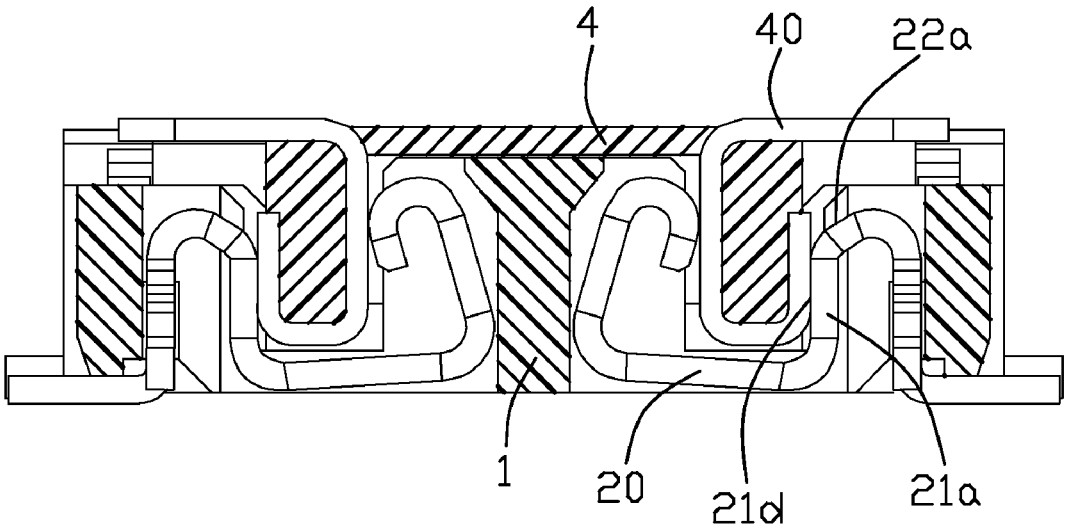
FIG. 7 is a cross-section view of the electrical connector and mating connector in FIG. 6.

Referring to FIG. 1, an electrical connector 1 in accordance with the present invention is provided. The electrical connector 1 comprises a rectangular insulating housing 10, a plurality of contacts 20 retained in said insulating housing 10, and a pair of retaining members 30 retained on two ends of said insulating housing 10. As shown in FIGS. 2 and 3, said insulating housing 10 has a bottom wall 11, a rectangular tongue portion 12 upwardly projecting from a middle area of said bottom wall 11, and a peripheral wall 13 surrounds said tongue portion 12. Said peripheral wall 13 and said tongue portion 12 define a receiving room 100 therebetween for receiving a mating connector 4 as shown in FIG. 5. Said peripheral wall 13 consists of a pair of longitudinal sidewalls 14 and a pair of transverse end walls 15 connecting with said longitudinal sidewalls 14. The sidewall 14 defines a plurality of passageways 140 extending vertically in an inner surface thereof. Said passageways 140 go through said bottom wall 11 and corresponding with a plurality of slots 120 formed on the tongue portion 12 respectively for receiving said contacts 20. The bottom wall 11 has a plurality of horizontal channels 110 connecting with said passageways 140 and said slots 120 respectively. Said end walls 15 has a pair of receiving grooves 150 for receiving said retaining members 30.

Referring to FIG. 3, said retaining member 30 has a horizontal base portion 31 which is assembled on said end walls 15 transversely, a pair of flanges 32 horizontally extending from two ends of said base portion 31 along a longitudinal direction, and a pair of soldering tabs 33 formed on a bottom edge of said flanges 32 and horizontally extending out of said receiving grooves 150. Said base portion 31 has a locking tab 34 formed on a bottom edge thereof for engaging with said receiving groove 150. Said flanges 32 and said base portion 31 define a U-shaped body engaging with the insulating housing 10. The base portion is received into said receiving groove 150 while the flanges 32 are located on an outer surface of said sidewalls 14. Said soldering tabs 33 are arranged beside said soldering portions 24 of said contacts 20 along the longitudinal sidewall 14.

Figure 4:
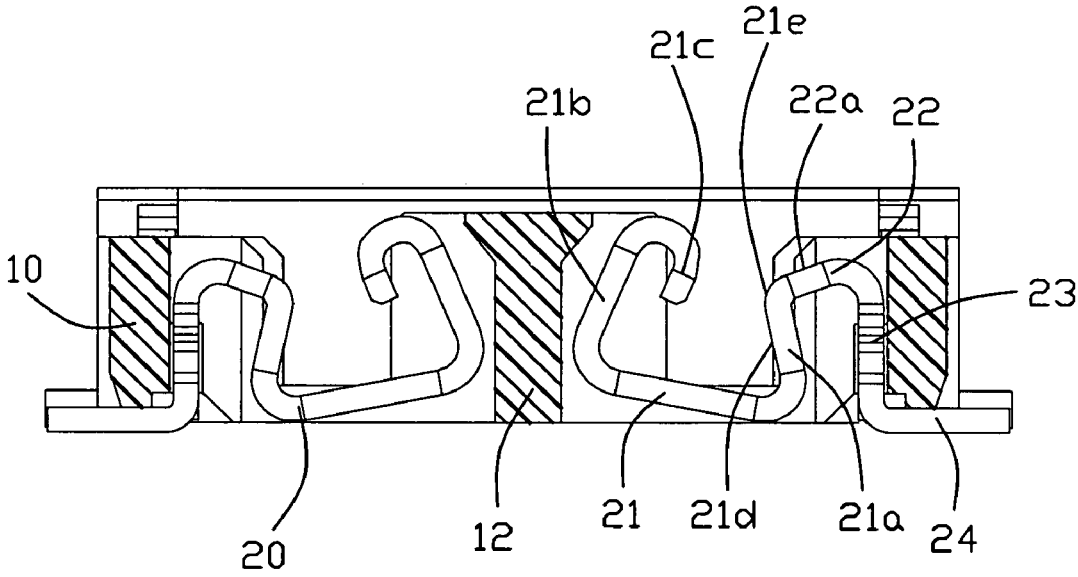
FIG. 4 is a cross-section view of the electrical connector in FIG. 1, showing the contacts retained in the insulating housing.

Referring to FIG. 3 to FIG. 4, said contact 20 stamped from metal sheet includes a substantial U-shaped contacting portion 21 located in said slot 120 and passageway 140, a holding portion 23 retained in the inner side of the passageways 140, a connecting portion 22 engaged with said contacting portion 21 and said holding portion 23 at their top ends, and a soldering portion 24 extending horizontally from a bottom edge of said holding portion 23. Said U-shaped contacting portion comprises a first supporting arm 21*a* retained in said passageway, a second supporting arm 21*b* retained in said slot 120 and a bottom arm retained in said channel 110 for connecting with said first and second supporting arm 21*a*, 21*b*. Said first and second supporting arms 21*a*, 21*b* are formed slanted forward to each other. The second supporting arm 21*b* has a free tip end which extends downwardly towards said connecting portion 22.

The connecting portion 22 has a linear leading surface 22*a* formed downwardly slanted towards said contacting portion 21. Said first supporting arm 21*a* of the contacting portion 21 defines a linear slanted surface 21*d* downwardly slanting toward said holding portion 23. During the process of the assembly between said electrical connector 1 and said mating connector 4 as shown in FIG. 5, said linear leading surface 22*a* of the connecting portion 22 can smoothly lead a contact 40 of the mating connector 4 into a space which is formed between said first and second supporting arms 21*a*, 21*b* of the U-shaped contacting portion 21. A boundary portion 21*e* between said first supporting arm 21*a* and said connecting portion 22 forms an first contacting projection 21*e* contacting with said contact 40 of the mating connector 4 electrically, while said free tip end of the second contacting supporting arm 21*b* forms an arc-shaped second contacting projection 21*c* contacting with the contacts 40 electrically. Said first contacting projection 21*e* is located lower than said arc-shaped second contacting projection 21*c*. Said slanted surface 21*d* provides an elastic force and enhances the engagement effect between the U-shaped contacting portion 21 and the contacts 40 of the mating connector 4.

Figure 8:
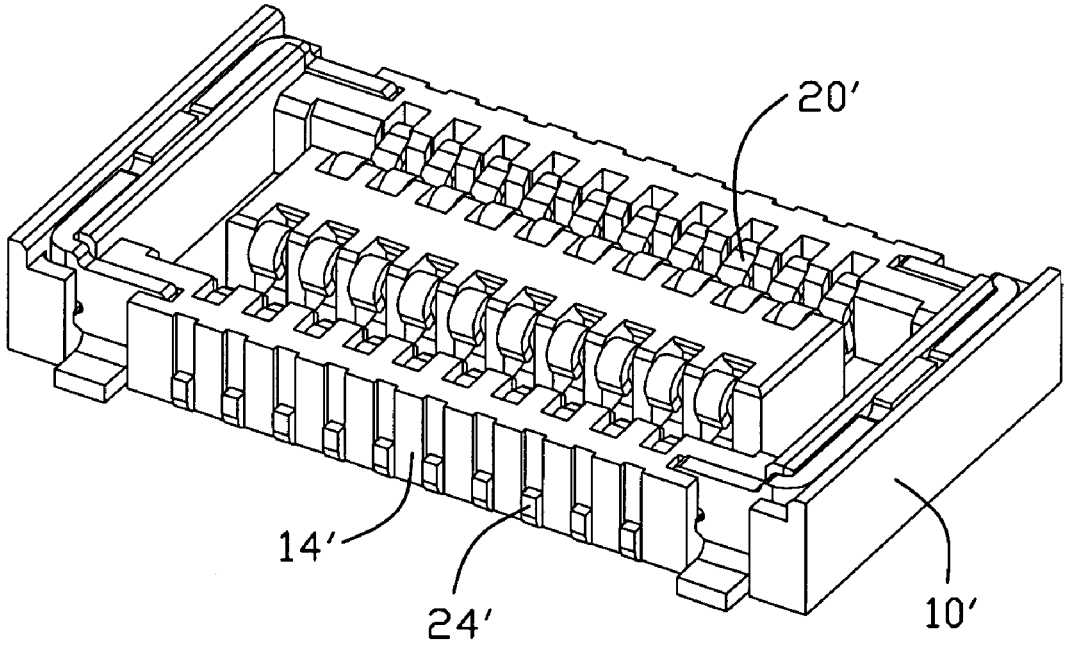
FIG. 8 is an assembled, perspective view of the electrical connector, showing a new type of contact in another embodiment of the present invention.
Figure 9:
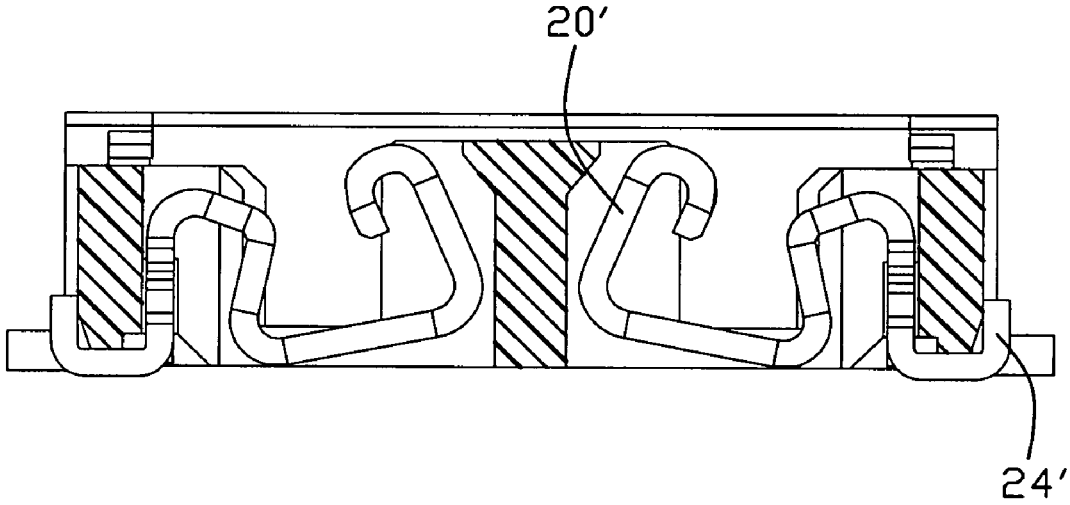
FIG. 9 is an cross-section view of FIG. 8, showing the new type contact assembled in the insulating housing in another embodiment of the present invention.

FIGS. 8 and 9 show another embodiment of the invention about a new type contact 20', the only difference between the contact 20' and said contact 20 is the soldering portion 24' which extends out from the insulating housing 10' and upwardly extends on an outer surface of the sidewall 14' in order to minish the electrical connector for saving the space of a PCB (printed circuit board).

However, while the preferred embodiment of the invention has been shown and described, it will apparent to those skilled in the art that changes and modifications may be made therein without departing from the spirit of the invention, the scope of which is defined by the appended claims.

What is claimed is:

1. An electrical connector comprising:

an insulating housing defining a pair of sidewalls and a plurality of passageways;

a plurality of contacts received in said passageways, each comprising a U-shaped contacting portion opening upward, a holding portion retained in insulating housing and a connecting portion connecting with said contacting portion and holding portion;

wherein said connecting portion has a planar leading surface downwardly slants towards said contacting portion, and said U-shaped contacting portion defines a first supporting arm which is adjacent to the holding portion and has a linear portion at an upper portion thereof to connect with the connecting portion;

wherein said linear portion of the first supporting arm has a planar slanted surface downwardly slanting toward the holding portion;

wherein said contacting portion has a second supporting arm, said first supporting arm and said second supporting arm are formed slanted forward to each other;

wherein said electrical connector further includes comprising a pair of retaining members assembled on two ends of said insulating housing, each retaining member has a horizontal base portion, a pair of flanges downwardly and horizontally extending from two ends of said base portion and a pair of soldering tabs formed on a bottom edge of said flanges and extending outwardly from the sidewalls; and wherein said base portion and said flanges of each retaining member define a U-shaped body engaged with said insulating housing.

2. The electrical connector as claimed in claim 1, wherein said base portion of the retaining member has a locking tab formed on a bottom edge thereof and extending downwardly into said insulating housing.

3. The electrical connector as claimed in claim 1, wherein said contacts each further includes a soldering portion which extends out from the insulating housing and vertically extends on an outer surface of the sidewall.

4. A contact retained in an electrical connector comprising:

a U-shaped contacting portion defining a first supporting arm and a second supporting arm;

a holding portion located adjacent to said first supporting arm;

a linear connecting portion connecting with a top end of said holding portion and a top end of said first supporting arm;

a soldering portion extending from said holding portion and away from said U-shaped contacting portion;

wherein said connecting portion defines a planar leading surface, and the top end of said holding portion is higher than that of said first supporting arm;

wherein said first supporting arm defines a linear portion at an upper portion thereof to connect with the connecting portion, and the linear portion slants downwardly toward said holding portion;

wherein a boundary portion between said first supporting arm linear portion and said connecting portion defines an arc-shaped first contacting projection;

wherein said second supporting arm has a free tip end defining an arc-shaped second contacting projection which is located higher than said first contacting projection; and wherein said first supporting arm, said connecting portion and said holding portion form another small U-shaped portion.

5. An electrical connector assembly comprising:

a first connector including:

a first insulative housing defining a pair of sidewalls and a plurality of first passageways therein;

a plurality of first contacts disposed in the corresponding passageways, respectively, each of said contacts including a first contact portion with a configuration of a trough like cross-section having a tiny downward U-shaped region at a free distal end thereof to form an inner contacting region thereof, said configuration of said trough like cross-section further defining an outer straight contacting arm to form an outer contacting region thereof;

a second connector including:

a second insulative housing with a plurality of second contacts therein, each of said second contacts defining an upside down second contact portion with an outer vertical arm and an inner vertical arm thereof;

wherein the inner vertical arm of the second contact engages the inner contacting region in a point engagement manner while the outer vertical arm of the second contact engages the outer contacting region in a linear engagement manner;

wherein said second contact portion is received within the configuration of the trough like cross-sectional of the first contact;

wherein said outer vertical arm defines a planar leading surface downwardly slants towards said inner vertical arm;

wherein said first electrical connector further includes comprising a pair of retaining members assembled on two ends of said insulating housing, each retaining member has a horizontal base portion, a pair of flanges downwardly and horizontally extending from two ends of said base portion and a pair of soldering tabs formed on a bottom edge of said flanges and extending outwardly from the sidewalls; and wherein said base portion and said flanges of each retaining member define a U-shaped body.

* * * * *